US010412495B2

(12) United States Patent
Stitz

(10) Patent No.: US 10,412,495 B2
(45) Date of Patent: Sep. 10, 2019

(54) CUSTOMIZABLE JEWELRY AND WIRELESS AUDIO HEADSET SYSTEM

(71) Applicant: Kathleen E. Stitz, Port Orchard, WA (US)

(72) Inventor: Kathleen E. Stitz, Port Orchard, WA (US)

( * ) Notice: Subject to any disclaimer, the term of this patent is extended or adjusted under 35 U.S.C. 154(b) by 0 days.

(21) Appl. No.: 15/844,504

(22) Filed: Dec. 15, 2017

(65) Prior Publication Data

US 2018/0184204 A1 Jun. 28, 2018

Related U.S. Application Data

(60) Provisional application No. 62/438,679, filed on Dec. 23, 2016.

(51) Int. Cl.

| | |
|---|---|
| ***H04R 25/00*** | (2006.01) |
| ***H04R 5/033*** | (2006.01) |
| ***H04R 1/10*** | (2006.01) |
| ***A44C 15/00*** | (2006.01) |

(52) U.S. Cl.
CPC ..... *H04R 5/0335* (2013.01); *A44C 15/003* (2013.01); *A44C 15/0015* (2013.01); *H04R 1/10* (2013.01); *H04R 2420/07* (2013.01)

(58) Field of Classification Search
CPC .... H04R 1/105; H04R 1/1016; H04R 1/1041; H04R 1/1066; H04R 25/65; H04R 25/02
See application file for complete search history.

(56) References Cited

U.S. PATENT DOCUMENTS

| | | | | |
|---|---|---|---|---|
| 8,804,992 | B2 * | 8/2014 | Bailey | H04R 1/105 343/718 |
| 10,057,397 | B2 * | 8/2018 | Kim | H04R 1/08 |

* cited by examiner

*Primary Examiner* — Amir H Etesam
(74) *Attorney, Agent, or Firm* — Christopher Mayle; John D. Houvener; Bold IP, PLLC

(57) ABSTRACT

Embodiments for a customizable jewelry and wireless audio headset system are provided. The system includes a wireless audio headset with a housing to store multiple electrical components, at least one jewelry accessory, at least one connecting component to secure jewelry accessories to the housing of the wireless audio headset, and a securing mechanism to create a loop and secure the system around the user's neck.

16 Claims, 6 Drawing Sheets

CUSTOMIZABLE JEWELRY AND WIRELESS AUDIO HEADSET SYSTEM

CROSS-REFERENCE TO RELATED APPLICATIONS

This application claims priority to U.S. Provisional Application No. 62/438,679 filed on Dec. 23, 2016. The content of the above application is incorporated by reference in its entirety.

FIELD OF THE DISCLOSURE

This disclosure relates generally to the field of personal audio listening devices. More specifically, the present invention is a wireless audio headphone system that is to be worn as customizable and functional jewelry.

BACKGROUND

Personal audio listening devices are everywhere, and most people don't leave home without them. This is largely due to significant improvements in hand-held music player technology, especially due to the seamless incorporation of digital music players into mobile/cellular phones. In order to maximize the listening experience and to take full advantage of the ever improving digital music player technology, audio headsets, such as ear bud-style or around-the-ear headphones, have also had to improve.

One issue with audio headsets involves wires and cables, that is, most audio headsets still use wires and cables to connect to audio players. Although wired devices often provide excellent sound quality, are usually more affordable than wireless alternatives and counterparts, and do not depend on an independent battery source, wires and cable usually manage to get caught on random objects. Imagine someone is walking around the house and using her favorite wired audio headset to listen to music that she has uploaded to her mobile phone when suddenly, the wire connecting the audio headset to the mobile phone gets caught on a door handle and the wire itself is damaged or the audio headset flies off her head. This unfortunate scenario happens to many people and can result in unusable audio headsets.

A simple remedy would be to get rid of the headphone-to-music player wires and cables altogether by using wireless headphones. Indeed, wireless technology like Bluetooth (a trademark of The Bluetooth Special Interest Group) short link wireless technology has been widely and publicly available for quite some time. In fact, wireless technology has also made many advances over the past few decades to be more user-friendly, ergonomic, and affordable. Some personal wireless audio headsets are even marketed as "wearable" technology, but although these headphones are "worn" around the neck, they are very noticeable and not fashionable.

For the foregoing reasons, there is a need for a customizable jewelry and wireless headphone system.

SUMMARY

In one aspect, a customizable jewelry and wireless audio headset system is presented herein according to one or more embodiments. In one, non-limiting embodiment, the system may include jewelry such as pendants and chains. The system may further include a wireless audio headset with a housing that can be customized with jewelry attachments. Further, the system, according to one or more embodiments, may include clasps to secure the headset around a user's neck.

In some embodiments, the preceding and following embodiments and descriptions are for illustrative purposes only and are not intended to limit the scope of this disclosure. Other aspects and advantages of this disclosure will become apparent from the following detailed description.

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
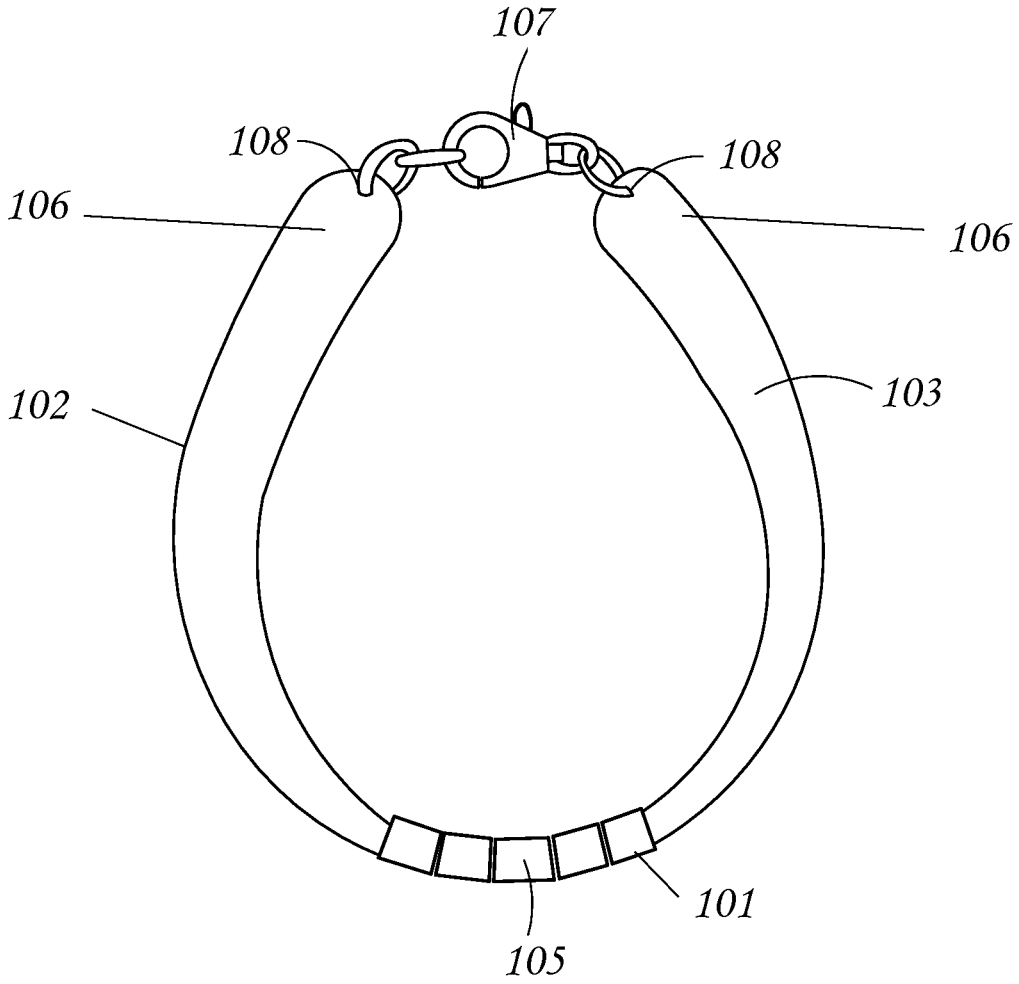
FIG. 1 is a top perspective view of the system showing an exemplary embodiment according to embodiments of the present disclosure.

In the Summary above, this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

Embodiments in the present description are generally directed to a customizable jewelry and wireless headset system. The one or more embodiments may be used for any type of jewelry and wireless audio headset known in the art or yet to be developed. This includes wireless audio headsets with or without structured housing.

One or more non-limiting embodiments for a customizable jewelry and wireless audio headset system may include the presence of (1) a wireless audio headset with a structured housing, (2) attachment components, (3) a securing mechanism to secure the audio headset around a user's neck, and (4) various jewelry components including, but not limited to, pendants, beads, chains, ribbon, and bows. Some or all of these above-identified elements may be used in one or more embodiments, and additional components other than those listed above may also be used in alternative embodiments. Further details are provided below with reference to the Figures.

Turning now to FIG. 1, FIG. 1 shows a jewelry and headset configuration, according to one or more embodiments, with jewelry accessories 101 such as beads enclosed around the housing 102 of the wireless audio headset 103. In one or more embodiments, the housing 102, has two ends 106 where the ear buds 201 are stored and taper towards the center or midpoint of its own structure, resulting in wide ends 104 with a narrow midsection 105. The housing is preferably tubular and hollow to house the electrical wires and components of the wireless audio headset including wires, wireless receivers, CPU components, Bluetooth receivers, power sources, microphones, control buttons, batteries, and similar components relevant or commonly found in the art. Alternative embodiments feature different styles, shapes, and sizes of the housing 102 to accommodate different jewelry accessories and fittings. A securing mechanism 107 such as a clasp chain is attached to the ends 106 of the housing 102 to secure the housing around a user's neck. One embodiment features end holes 108 drilled into the ends 106 and securing one end of the securing mechanism 107 within the end holes 107. A securing mechanism 107 such as a clasp chain allows for easy removal of the system when removal is desired, and it also helps maintain a secure fit when while the system is in use or being worn.

Figure 2:
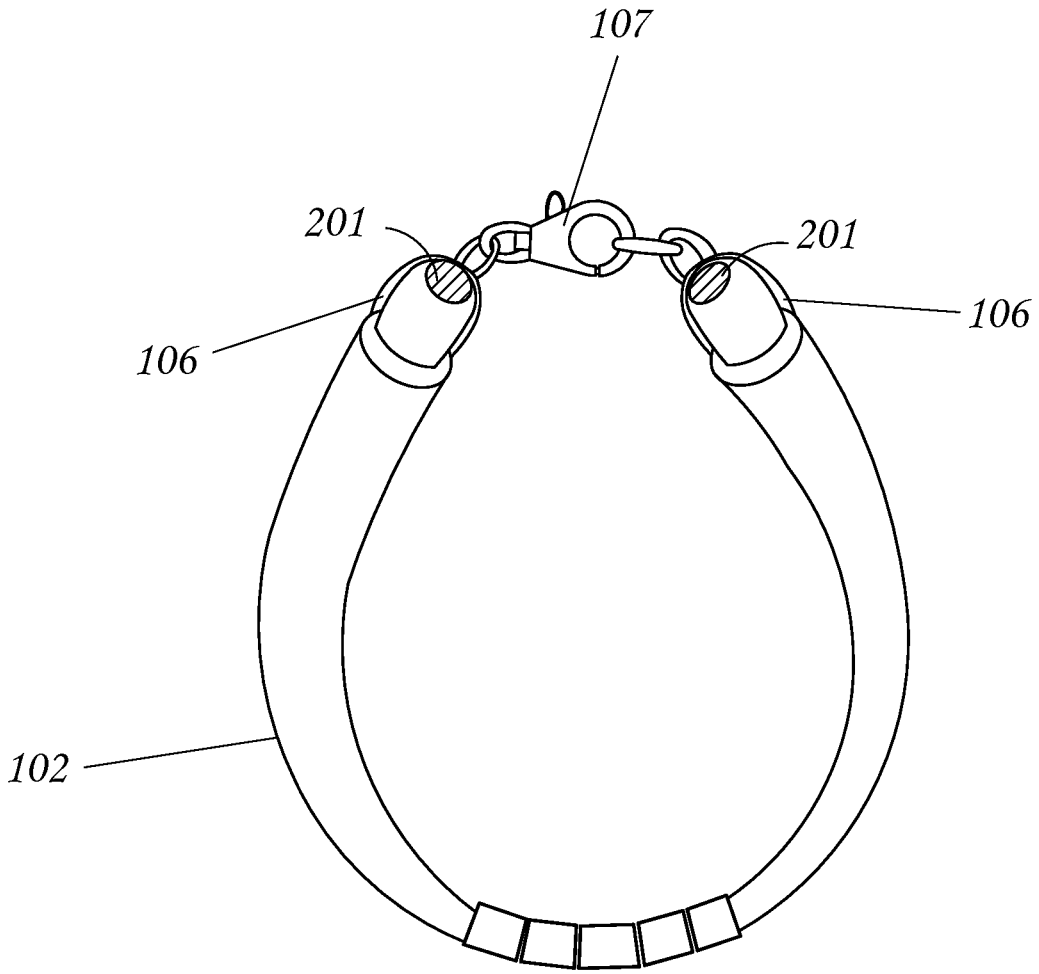
FIG. 2 is a bottom/rear perspective view of the system showing an exemplary embodiment with beads and the ear buds receded according to embodiments of the present disclosure.

FIG. 2 shows the rear or under side of the system. The ear buds 201 shown here are in their retracted position. When the user wants to listen to music, the user can pull on the ear buds 201 and extend the wire to a desired length in order to secure the ear buds into the user's ear. The ear buds 201 are preferably hidden when not in use by wearing the system in a position that hides the ear buds 201 under the ends 106 of the housing 102. The securing mechanism 107, in one or more embodiments, features permanently attached components such as elastic cordage or an elongated wire to form a continuous loop using the securing mechanism 107 and the housing 102. The securing mechanism 107 may also be a continuous band or chain with no means of unhooking so long as the user can fit his or her head through the loop made by the system and wear it around the neck. The ear buds 108 are located at both ends of the tubing which point towards the back of the neck when the present invention is worn on the neck. The ear buds 201, in one embodiment, may also be completely wireless and paired wirelessly to a wireless receiver found within the housing 102 or attached as a pendant to be worn as a jewelry piece.

Figure 3:
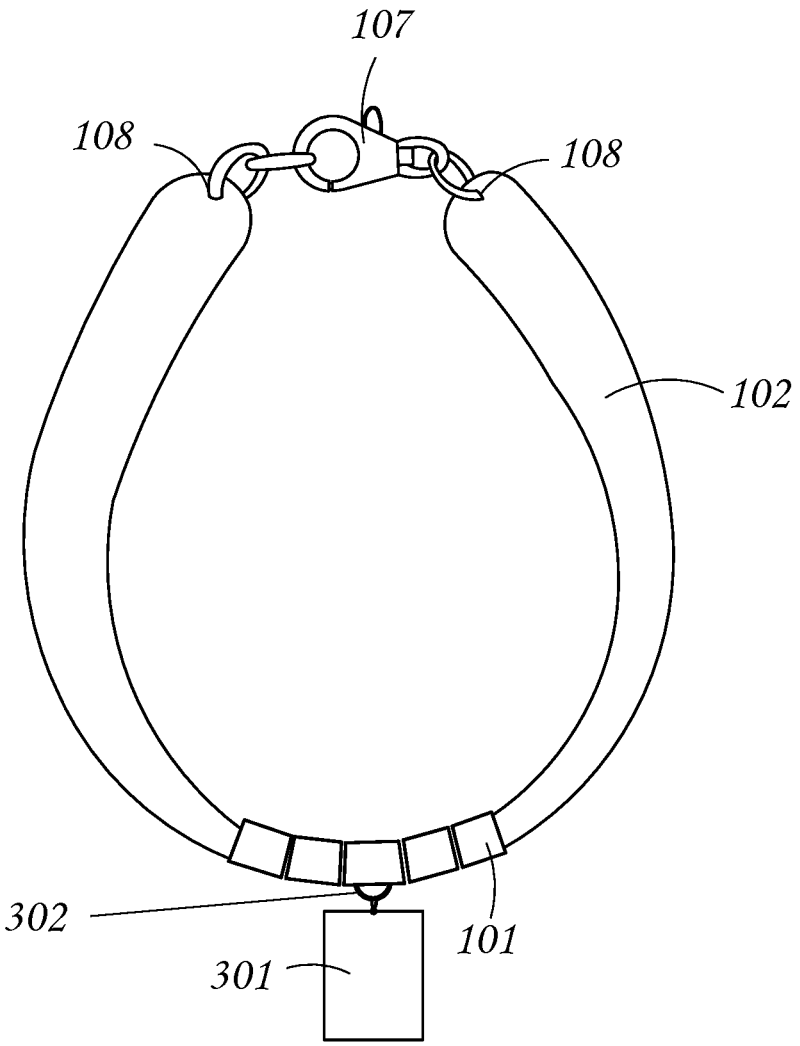
FIG. 3 is a top perspective view of the system showing beads and a pendant according to embodiments of the present disclosure.

FIG. 3 shows a front view of one embodiment with multiple jewelry accessories 101 including beads and a pendant 301. The pendant 301, according to one embodiment, can be secured to the housing 102 at any location, preferably through holes drilled into the housing 102 and a connecting component 302. The connecting component 302 may be a ring or a clasp or similar connector items common in the art. Further, in one or more embodiments, the connecting component may be permanently attached to the housing 102 or other jewelry accessories 101. In other embodiments, the connecting component 302 may be removably attached. Either a permanent or removable attachment of the connector component 302 will provide the user to fully customize the audio headset 103 with various jewelry accessory items 101.

Figure 4:
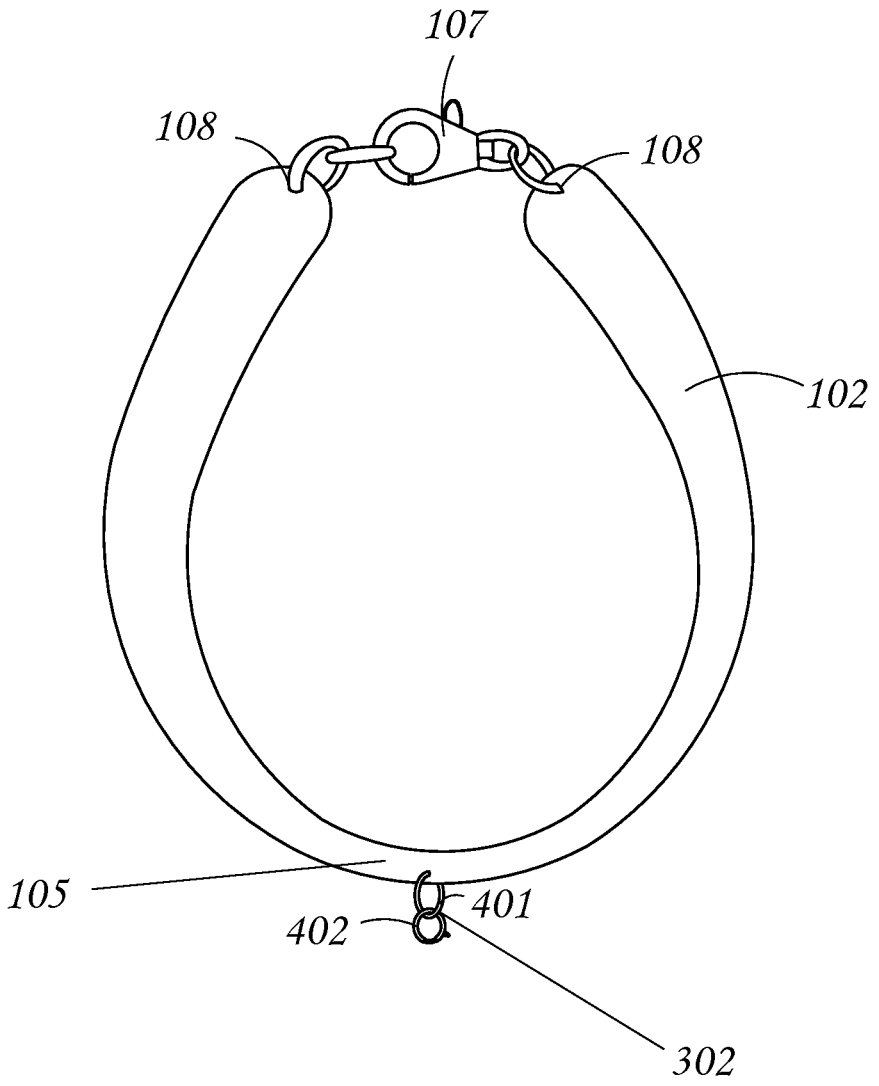
FIG. 4 is a top perspective view of the system showing a clasp to attach different jewelry pieces such as a pendant according to embodiments of the present disclosure.

FIG. 4 shows a front view of one or more embodiments with a connecting component 302 attached to the midsection 105 of the housing 102 of the audio headset 103. The connecting component may have a first ring 401 threaded through a hole drilled into the housing 102 with a second clasp ring 402 interlocking with the first ring. The second clasp ring 402 allows the use to attach various jewelry accessories to the housing 102 such as pendants, crosses, beads, chains, and similar components common in the art. Further, in one or more embodiments, the connecting component 302 can be attached at multiple locations on the body. Additionally, in other embodiments, the connecting component 302 may be attached with bands, hooks, hook-and-loop bands, chains, ribbons, or similar connective components common in the art without requiring a hole to be drilled into the housing 102 of the audio headset 103.

Figure 5:
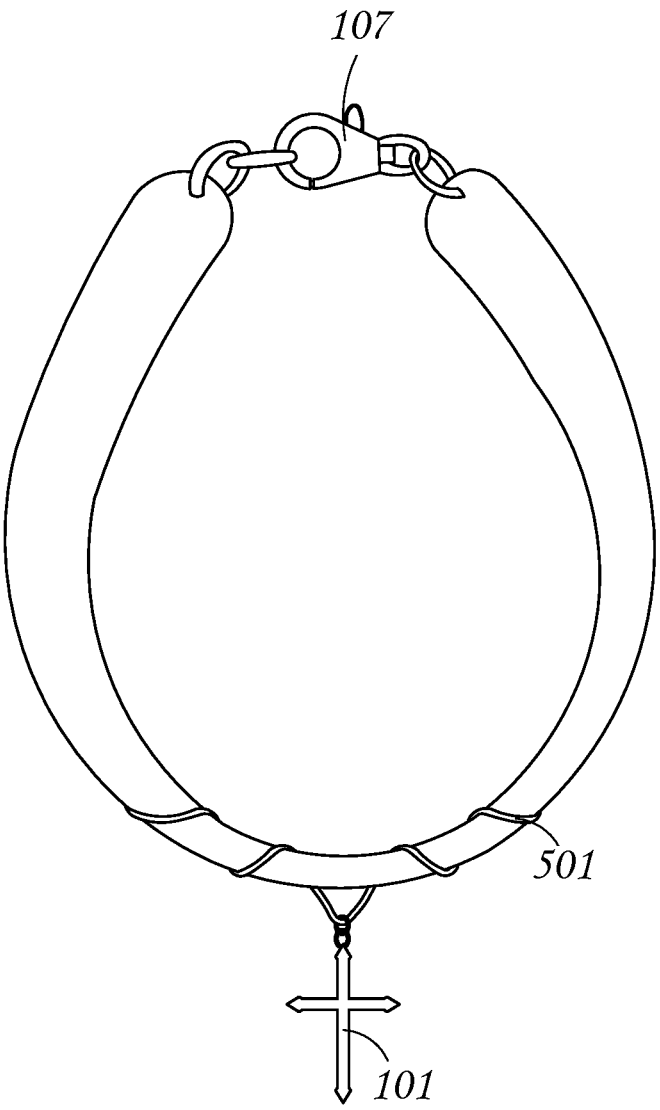
FIG. 5 is a top perspective view of the system showing a third alternative embodiment with cordage wrapped spirally with a pendant attached.

FIG. 5 shows a front view of one or more embodiments featuring an elongated connecting component 501 including ribbons, chains, or strings helically or spirally wrapped around the tubing of the housing. One or more jewelry accessories 101 including pendants, charms, beads, chains, and similar components common in the art may be attached to the elongated connecting components 501 in any desirable configuration. In other embodiments, the elongated connecting component 501 is secured to the housing 102 without wrapping so the elongated connecting component 501 can dangle.

Figure 6:
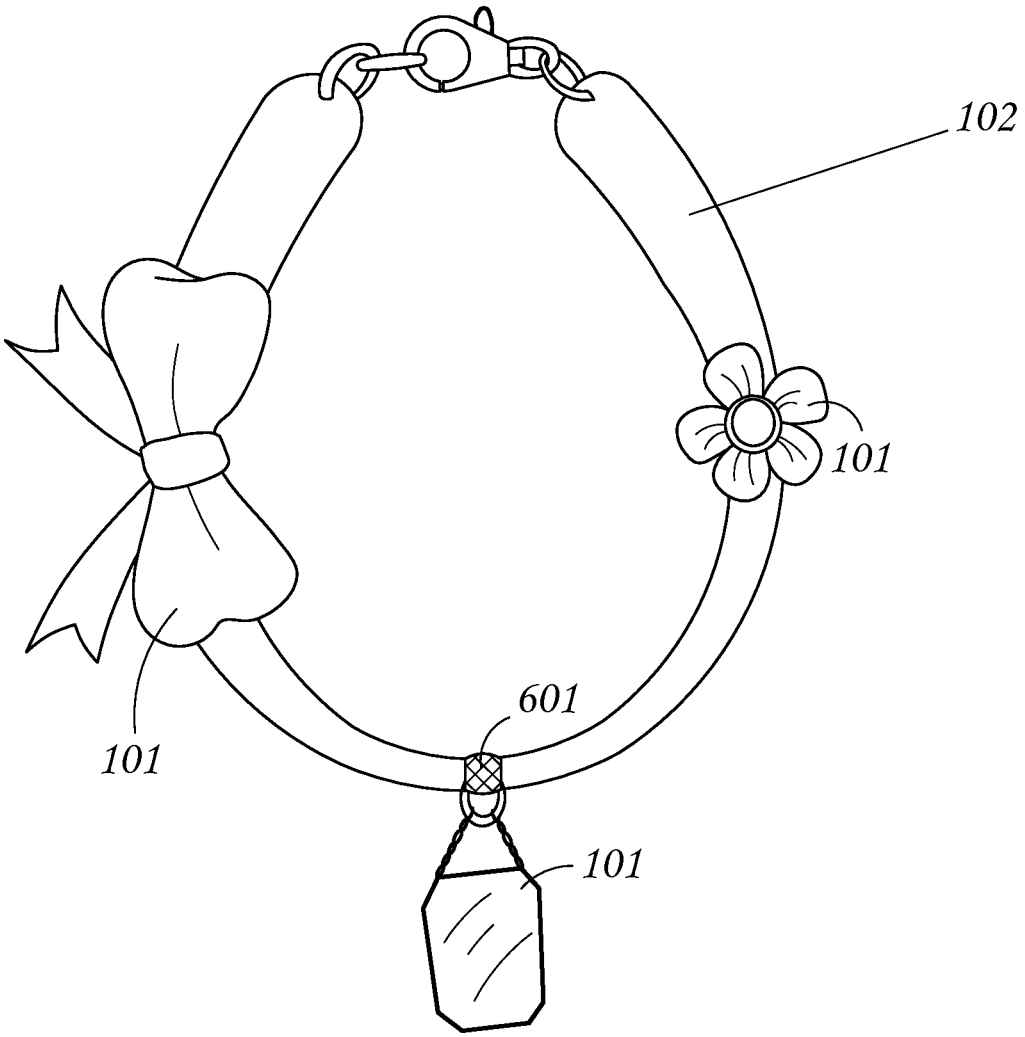
FIG. 6 is a top perspective view of the system showing a fourth alternative embodiment with different embellishments attached by hook and loop bands.

FIG. 6 shows a front view of one or more embodiments featuring jewelry accessories 101 secured to the housing 102 of the audio headset 103 by straps 601 such as hook-and-loop fasteners or bands wrapped around the housing 102.

The straps 601 may be a hook-and-loop fastener/bands or similar adhesive material so as to not damage the housing while maintaining functionality and versatility in customization. The straps 601 can be used with various jewelry accessories 101 including bows, ribbons, charms, disks, rings, etc.

The embodiments provided herein for a customizable jewelry and wireless audio headset system provide a number of advantages over the prior art. For example, the exemplary, non-limiting embodiments provided in the present disclosure may provide for a system with multiple means for securing jewelry components to a wireless audio headset system through permanent or nonpermanent methods. It is noted, that based on a number of experimental uses, the system according to embodiments in the present disclosure is more customizable and fashionable while being less difficult to wear.

While preferred and alternate embodiments have been illustrated and described, as noted above, many changes can be made without departing from the spirit and scope of the embodiments provided in the present disclosure. Accordingly, the scope of the embodiments provided in the present disclosure, is not limited by the disclosure of these preferred and alternate embodiments. Instead, the scope of the invention title be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶6. In particular, the use of "step of" in the claims herein is not intended to invoke the provisions of U.S.C. § 112 ¶6.

What is claimed is:

1. A wireless audio necklace system, comprising:

a housing having two ends, the two ends each having a well, the housing configured to be worn around a user's neck, the housing is hollow and configured to store one or more electrical components, the one or more electrical components including one or more ear buds, the ear buds stored in the wells of the two ends, the ear buds configured to point towards the back of the neck when the housing is worn around the user's neck, the ear buds connected to wires wherein the wires are configured to be extended to a longer length to secure the one or more ear buds into the user's ear; and a securing mechanism attached to the two ends of the housing to secure the housing around the user's neck.

2. The wireless audio necklace system of claim 1, wherein the securing mechanism is a clasp chain.

3. The wireless audio necklace system of claim 2, the securing mechanism connected to the housing by end holes drilled into the two ends of the housing, one end of the securing mechanism secured within the end holes.

4. The wireless audio necklace system of claim 2, the securing mechanism further comprising components such as elastic cordage or an elongated wire to form a continuous loop with the securing mechanism and the housing.

5. The wireless audio necklace system of claim 1, further comprising a jewelry component, the jewelry component configured to be secured to the housing by a connecting component, the connecting component configured so as to not damage the housing while jewelry component is secured to the housing.

6. The wireless audio necklace system of claim 5, the jewelry component secured to the housing by holes drilled into the housing and the connecting component.

7. The wireless audio necklace system of claim 6, the connecting component comprised of hook-and-loop fasteners or bands wrapped around the housing.

8. The wireless audio necklace system of claim 7, wherein the connecting component is a ring or a clasp.

9. The wireless audio necklace system of claim 8, wherein the connecting component is removably attached to the hollow housing.

10. The wireless audio necklace system of claim 7, the jewelry component is a pendant, bead, chain, ribbon, or bow.

11. The wireless audio necklace system of claim 1, the one or more ear buds taper towards the midpoint of their own structure.

12. The wireless audio necklace system of claim 1, wherein the housing is tubular.

13. The wireless audio necklace system of claim 1, wherein the housing is in the shape of a horse-shoe.

14. A wireless audio necklace system, comprising:

a housing having two ends, the housing tubular, hollow, and in the shape of a horse-shoe, the two ends each having a well, the housing configured to be worn around a user's neck, the housing configured to store one or more electrical components; the one or more electrical components including one or more ear buds, the ear buds stored in the wells of the two ends, the ear buds configured to point towards the back of the neck when the housing is worn around the user's neck, the ear buds hidden when not in use under the two ends of the housing; the ear buds connected to wires wherein the wires are configured to be extended to a longer length to secure the one or more ear buds into the user's ear;

a jewelry component, the jewelry component configured to be secured to the housing by a connecting component, the connecting component configured so as to not damage the housing while jewelry component is secured; and a securing mechanism attached to the two ends of the housing to secure the housing around the user's neck.

15. A method of using a wireless audio necklace system, comprising:

positioning the housing around a user's neck, the housing having two ends, the two ends each having a well, the housing storing one or more electrical components; the one or more electrical components including one or more ear buds, the ear buds stored in the wells of the two ends, the ear buds pointing towards the back of the neck when the housing is worn around the user's neck, the ear buds connected to wires, the ear buds hidden when not in use under the two ends of the housing;

extending the wires to a longer length; and securing the one or more ear buds into the user's ear; and securing the housing around the user's neck by a securing mechanism, the securing mechanism attaching to the two ends of the housing, the securing mechanism having components such as elastic cordage or an elongated wire to form a continuous loop using the securing mechanism and the housing.

16. The method of claim 15, securing a jewelry component to the housing by a connecting component, the connecting component not damaging the structural integrity hollow housing while jewelry component is secured.

* * * * *